US010756403B2

(12) United States Patent
Doumanis

(10) Patent No.: US 10,756,403 B2
(45) Date of Patent: Aug. 25, 2020

(54) FILTER COMPRISING RESONATOR ASSEMBLIES INCLUDING A FIRST CAVITY WITH A FIRST RESONANT MEMBER AND A SECOND CAVITY WITH A SECOND RESONANT MEMBER, WHERE A PART OF THE FIRST CAVITY FORMS THE SECOND RESONANT MEMBER

(71) Applicant: Alcatel Lucent, Boulogne-Billancourt (FR)

(72) Inventor: Efstratios Doumanis, Blanchardstown (IE)

(73) Assignee: Alcatel Lucent, Nozay (FR)

( * ) Notice: Subject to any disclaimer, the term of this patent is extended or adjusted under 35 U.S.C. 154(b) by 38 days.

(21) Appl. No.: 15/570,945

(22) PCT Filed: Apr. 8, 2016

(86) PCT No.: PCT/EP2016/057711
§ 371 (c)(1),
(2) Date: Oct. 31, 2017

(87) PCT Pub. No.: WO2016/177532
PCT Pub. Date: Nov. 10, 2016

(65) Prior Publication Data

US 2018/0294541 A1 Oct. 11, 2018

(30) Foreign Application Priority Data

May 1, 2015 (EP) ..... 15305678

(51) Int. Cl.
*H01P 1/205* (2006.01)
*H01P 1/213* (2006.01)
(Continued)

(52) U.S. Cl.
CPC ..... *H01P 1/2053* (2013.01); *H01P 1/2136* (2013.01); *H01P 7/04* (2013.01); *H01P 7/06* (2013.01)

(58) Field of Classification Search
CPC ..... H01P 1/2053; H01P 7/04; H01P 7/105; H01P 1/2136
(Continued)

(56) References Cited

U.S. PATENT DOCUMENTS 6,614,327 B2 * 9/2003 Saito et al. ..... H01P 1/2086 333/134
2001/0026202 A1 * 10/2001 Raty ..... H01P 1/2053 333/222
(Continued)

FOREIGN PATENT DOCUMENTS

FR 2 576 456 A1 7/1986

OTHER PUBLICATIONS

Evaristo Musonda et al., "Microwave Bandpass Filters Using Re-Entrant Resonators," IEEE Transactions on Microwave Theory and Techniques, vol. 63, No. 3, pp. 954-964, XP011574138, Mar. 2015.
(Continued)

*Primary Examiner* — Benny T Lee
(74) *Attorney, Agent, or Firm* — Fay Sharpe LLP

(57) ABSTRACT

A cavity resonator assembly and filters formed from assemblies are provided. The resonator assembly comprising: a first resonator cavity, a first resonant member, and a first signal feed; a second resonator cavity, a second resonant member, and a second signal feed. The first resonant member is-located within the first resonator cavity, arranged to receive a signal from the first signal feed and configured to resonate within the first cavity at a first fundamental frequency. The second resonant member is-located within the second resonator cavity, arranged to receive a signal from
(Continued)

the second signal feed and configured to resonate within the second cavity at a second fundamental frequency. At least a portion of the second cavity is housed within the first resonant member. The first resonator cavity surface from which the first resonant member extends is offset from a second resonator cavity surface from which the second resonant member extends.

20 Claims, 6 Drawing Sheets

(51) Int. Cl.
*H01P 7/04* (2006.01)
*H01P 7/06* (2006.01)

(58) Field of Classification Search
USPC ..... 333/202, 222
See application file for complete search history.

(56) References Cited

U.S. PATENT DOCUMENTS

2003/0052571 A1* 3/2003 Mikkonen ..... B21C 23/20 310/311
2014/0132372 A1 5/2014 Wiehler et al.
2014/0347148 A1 11/2014 Ruiz-Cruz et al.

OTHER PUBLICATIONS

Jorge A. Ruiz-Cruz et al., "Triple-Conductor Combline Resonators for Dual-Band Filters With Advanced Guard-Band Selectivity," IEEE Transactions on Microwave Theory and Techniques, vol. 60, No. 12, pp. 3969-3979, XP011484729, Dec. 2012.
International Search Report for PCT/EP2016/057711 dated Jun. 22, 2016.
European Patent Application No. 15305678.3-1812, Extended European Search Report, dated Nov. 5, 2015, 9 pages.
PCT Patent Application No. PCT/EP2016/057711, Written Opinion of the International Searching Authority, dated Jun. 22, 2016, 7 pages.

* cited by examiner

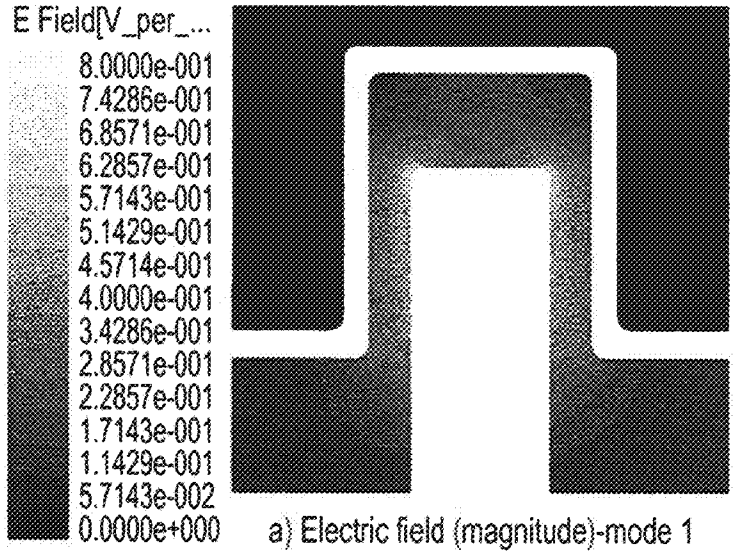
a) Electric field (magnitude)-mode 1
FIG. 4a
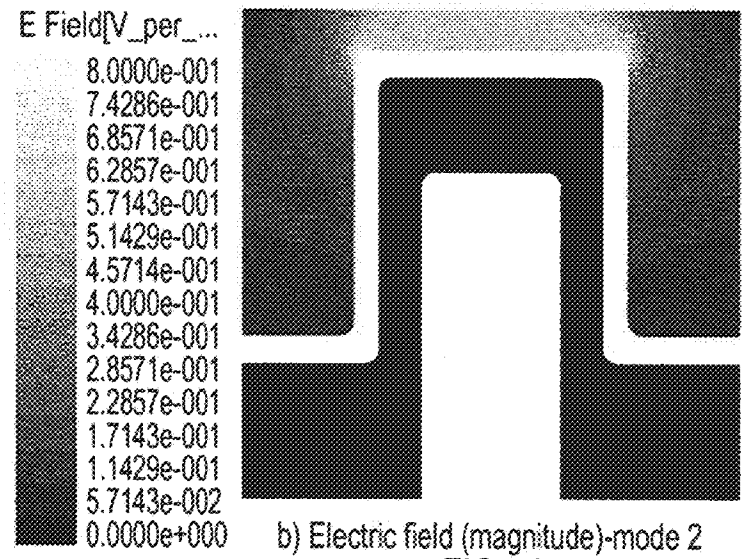
b) Electric field (magnitude)-mode 2
FIG. 4b
c) Magnetic field (magnitude)-mode 1
FIG. 4c
d) Magnetic field (magnitude)-mode 2
FIG. 4d a) Dual-mode Electric field (magnitude)

b) Dual-mode Magnetic field (magnitude)

FILTER COMPRISING RESONATOR ASSEMBLIES INCLUDING A FIRST CAVITY WITH A FIRST RESONANT MEMBER AND A SECOND CAVITY WITH A SECOND RESONANT MEMBER, WHERE A PART OF THE FIRST CAVITY FORMS THE SECOND RESONANT MEMBER

FIELD OF THE INVENTION

The present invention relates to a cavity resonator assembly and filters formed from such cavity resonator assemblies.

BACKGROUND

Filters formed from coaxial cavity resonators are widely used in data transmission systems and, in particular, telecommunications systems. In particular, filters formed from cavity resonators are often used in base stations, radar systems, amplifier linearization systems, point-to-point radio and radio frequency (RF) signal cancellation systems.

Although filters tend to be chosen or designed depending on a particular application, there are often certain desirable characteristics common to all filter realisations. For example, the amount of insertion loss in the pass band of a filter ought to be as low as possible, whilst the attenuation in the stop band should be as high as possible. Furthermore, in some applications the frequency separation between the pass band and stop band (i.e., guard band) may need to be very small, which can require filters of high order to be deployed in order to achieve such a specific requirement. However, requirements for high order filters are typically followed by an increase in cost due to a greater number of components and an increase in the need for space which is often at a premium in telecommunications implementations such as those listed above.

One challenging task in filter design is that of reducing the size of the filters whilst retaining their operational characteristics, including electrical performance. It is desired to provide smaller filters which have performance characteristics that are comparable to much larger structures. With the arrival of small cells within telecommunication systems and the need to provide multiband solutions within a similar footprint to that of single band solutions, there is an increasing need to reduce the size of various telecommunication components including filters.

It is desired to provide a cavity assembly which can be used in a filter to address some of the issues currently being faced in filter design.

SUMMARY OF THE INVENTION

Accordingly, a first aspect provides a resonator assembly comprising: a first resonator cavity, a first resonant member, and a first signal feed; a second resonator cavity, a second resonant member, and a second signal feed; the first resonant member being located within the first resonator cavity, arranged to receive a signal from the first signal feed and configured to resonate within the first cavity at a first fundamental frequency; the second resonant member being located within the second resonator cavity, arranged to receive a signal from the second signal feed and configured to resonate within the second cavity at a second fundamental frequency; wherein at least a portion of the second cavity is housed within the first resonant member, and wherein a first resonator cavity surface from which the first resonant member extends is offset from a second resonator cavity surface from which the second resonant member extends.

The first aspect recognises that in microwave filters and duplexers which use coaxial cavity technology, the basic building block is that of a coaxial resonator. The coaxial resonator can be thought of as a distributed transmission line with an element which has an associated physical length configured to provide a required electrical length to support a standing wave at a given frequency. That frequency becomes the frequency of operation for the resonator in a resulting filter. A conventional TEM combline/coaxial resonator assembly comprises: a metallic cavity enclosure, often having a circular or rectangular shaped cross-section. Located within that metallic cavity enclosure there is a resonant member. That resonant member typically takes the form of a cylindrical metallic post located at the centre of the circle or rectangle of the metallic cavity structure. The metallic post is typically grounded at one side and open-ended at the opposite side.

The first aspect recognises that it is possible to provide a resonant assembly which can allow for the provision of more than one cavity within a volume normally suited to a single cavity. The plurality of cavities may be configured such that the resonant assembly can support the same, or different, resonant frequency in each of the cavities. Such a resonant assembly may allow for creation of a coaxial cavity resonator operable to support two resonant modes. Such a resonant assembly may be deployed in compact dual mode filters. The first aspect recognises that it is possible to provide one resonant mode per pass band for emerging dual band wireless base station filter applications.

Arrangements in accordance with the first aspect may support two resonant modes within a reduced physical space, thereby allowing the resonator to be used to form compact dual mode filters. It will be appreciated that one possible use of the first aspect might be within dual band wireless base station filter applications. In such a scenario it is possible to construct a cavity assembly which is operable to provide resonant frequency bands which are in relatively close proximity, for example 1800/1900 MHz.

It has been recognised that it is possible to form a dual band filter within a space similar to that used for a single band. According to such an arrangement, each combline resonator may provide one resonant mode per pass band. FIG. 1 illustrates schematically a physical configuration of a combline resonator which can be used to form a dual band filter within a space similar to that used for a single band. The structure shown schematically in FIG. 1 comprises three metallic conductors. The metallic conductors comprise an inner metallic resonating element (in this case, an inner post); an intermediate conductor (in this case, a cylinder of substantially square cross-section and having an open end is located around the inner post); and a cavity enclosure that forms a cavity around the intermediate conductor. The inner and intermediate conductors are short-circuited by the cavity enclosure at one of their ends and are open-ended at the other end. The lengths of the inner and intermediate conductors are selected to be close to $\lambda/4$ for the desired resonant frequencies. The lengths of the inner post and intermediate conductor may be different in order to precisely control the resonant frequency of the two modes supported by the structures. The cross-section of such a resonator can be seen in FIG. 1 and the structure illustrated operates to provide two asynchronous resonant modes which may be suited to realise compact microwave dual band filters. However, the first aspect recognises that an arrangement such as that shown in FIG. 1 may lead to complex filter construction and that there may be problems with the operation of any filters formed from more than one such cavity.

The first aspect may provide a resonator assembly or resonant structure. That assembly or structure may comprise a first resonator cavity and a second resonator cavity. Each cavity may comprise a conductive metal enclosure or may comprise an enclosure including a metallic inner coating. That is to say it is the wall surfaces of a cavity which may be conductive. Each resonator cavity may contain therein a resonant member. That resonant member may take various forms and may, for example, comprise, for example, a post. That post may be substantially solid or may be hollow. The post may be of substantially regular cross-section along its length, or may, for example, comprise a head portion which has a greater cross-sectional area. Each resonator cavity may include a signal feed. That signal feed may comprise a conductive wire signal feed or an appropriate signal coupling which allows a signal to couple into the conductive cavity. The first resonant member maybe located within the first conductive resonator cavity, and may be arranged to receive a signal from a first signal feed and configured to resonate within the first cavity at a first fundamental frequency.

The second resonant member may be located within the second resonator cavity, arranged to receive a signal from a second signal feed and configured to resonate within the second cavity at a second fundamental frequency. At least a portion of the second cavity may be housed within the first resonant member. That is to say, the first resonant member may comprise a hollow member and the hollow inside of the first resonant member may form part of the second resonant cavity. The hollow inside of the first resonant member may form the majority of the second resonant cavity. The hollow inside of the first resonant member may form only part of the second resonant cavity. The first conductive resonator cavity surface from which the first resonant member extends is offset from a second conductive resonator cavity surface from which the second resonant member extends. That is to say, the first and second resonant member may be configured to have a different effective ground planes.

The first aspect recognises that by arranging one cavity within another cavity it may be possible to save space, and that with arrangements in which a part, rather than all, of the second cavity lies within the first resonant member and/or in which a first conductive resonator cavity surface from which the first resonant member extends is offset from a second conductive resonator cavity surface from which the second resonant member extends, it may be possible to allow the part of the second cavity which is outside the first resonant member to have greater cross sectional area, and/or a greater volume than the part of the cavity inside the first resonant member, thereby providing space for greater energy storage.

Furthermore, the first aspect recognises that by configuring the first and second resonant members such that are attached to different cavity base surface planes, such that those cavity bases are offset from each other may assist with provision of a volume for energy storage in the second resonator cavity. Configuring the first and second resonant members to have offset cavity bases, may also ease coupling arrangements between first and/or second resonant cavities of adjacent resonant assemblies in accordance with the first aspect, thereby aiding filter construction and design.

According to one embodiment, the first and second cavities are configured to be substantially electrically and magnetically isolated from each other. Accordingly, operation of each cavity (first or second) may be substantially independent to operation of the other cavity. Accordingly, each cavity may be tuned independently. The independence of cavities may make a resonator assembly particularly suited to use as a duplexing unit in a frequency division duplexing system. That is to say, one resonant cavity may be used for transmission and another for reception. Furthermore, it will be appreciated that the high level of isolation between the two resonances may allow for a minimum sacrifice in overall Q-factor.

According to one embodiment, the second resonator cavity comprises a cavity having a non-uniform cross-sectional area along its length. According to one embodiment, the second resonator cavity is configured in a general form of an inverted mushroom, a stem of the mushroom forming the first resonant member. Accordingly, there may be provided an increased volume within which to store magnetic energy at resonance. Compared to known arrangements, some arrangements can allow for an improved physical configuration in relation to the coaxial resonating members in each cavity of the enclosure, the configuration allowing volume for magnetic energy storage and suppressing volume for electric energy storage, thus increasing in two ways the efficiency of the resonator and saving overall resonator assembly volume.

According to one embodiment, at least one of the first and second resonator cavities comprises: a tunable screw extending into the resonator cavity. It will be appreciated that provision of appropriate tuning screws in relation to the resonating members positioned in each cavity may allow for tuning of the appropriate resonating cavity. According to one embodiment, the second resonant member is formed from a tunable screw insert extending into the second conductive resonator cavity.

According to one embodiment, the first and second fundamental frequencies are different. According to one embodiment, the first and second fundamental frequencies are substantially identical. If the first and second frequencies are different, the cavities may be independently fed and a signal may be extracted from each cavity independently. If the first and second frequencies are the same, the cavities may be still be independently fed and a signal may be extracted from each cavity independently or the cavities may be still fed by a common signal feed, or the signal may be coupled between cavities. The two-cavity arrangement of the enclosure may offer for particularly flexible operation.

According to one embodiment, the first and second cavities are configured so that the second signal feed is configured to receive a signal from the first conductive resonator cavity. In some embodiment, capacitative coupling is provided between cavities. Accordingly, a capacitative probe may link the cavities. In some embodiments, inductive coupling is provided between cavities. Accordingly, one or more apertures may link the cavities. According to one embodiment, the first and second signal feeds may comprise a single signal feed. That is to say, both cavities may be fed by the same signal feed.

According to one embodiment, configuring the first or second resonant member to resonate within the cavity at the first or second fundamental frequency respectively comprises: selecting at least one physical dimension of the resonant member.

According to one embodiment, at least one of the first and second resonant member comprises a resonating post. The first resonator post may comprise a hollow metallic post. The second resonator post may comprise a solid metal post or screw.

A second aspect provides a filter comprising: a plurality of resonator assemblies, at least one of the resonator assemblies comprising a resonator assembly according to the first aspect, the filter comprising an input resonator assembly and an output resonator assembly arranged such that a signal received at the input resonator assembly passes through the plurality of resonator assemblies and is output at the output resonator assembly; an input feed line configured to transmit a signal to an input resonator member of the input resonator assembly such that the signal excites the input resonator member, the plurality of resonator assemblies being arranged such that the signal is transferred between the corresponding plurality of resonator members to an output resonator member of the output resonator assembly; an output feed line for receiving the signal from the output resonator member and outputting the signal.

According to one embodiment, the filter comprises at least two adjacent resonator assemblies comprising a resonator assembly according to the first aspect, and wherein the adjacent resonator assemblies are configured such that a signal can be passed between adjacent first conductive resonator cavities and a signal can be passed between adjacent second conductive resonator cavities. According to one embodiment, the filter comprises at least two adjacent resonator assemblies comprising a resonator assembly according to the first aspect, and wherein the adjacent resonator assemblies are configured such that a signal can be passed between adjacent first conductive resonator cavities or a signal can be passed between adjacent second conductive resonator cavities. Accordingly, since it will be understood that the two resonant cavities may be configured such that they support different resonant frequencies or the same resonant frequency and in either case it is possible to feed the relevant cavities independently or simultaneously. Various modes of filter operation therefore follow.

According to one embodiment, the filter is configured to form a filter of a duplexer.

According to one embodiment, the filter is at least one of: a radio frequency filter or a combline filter.

Further particular and preferred aspects are set out in the accompanying independent and dependent claims. Features of the dependent claims may be combined with features of the independent claims as appropriate, and in combinations other than those explicitly set out in the claims.

Where an apparatus feature is described as being operable to provide a function, it will be appreciated that this includes an apparatus feature which provides that function or which is adapted or configured to provide that function.

BRIEF DESCRIPTION OF THE DRAWINGS

Embodiments of the present invention will now be described further, with reference to the accompanying drawings, in which:

FIGS. 4*a* and 4*b* illustrate the distribution of electric field (magnitude) across a vertical plane of one possible resonator volume, for resonant, fundamental modes one and two respectively;

FIGS. 4*c* and 4*d* illustrate the distribution of magnetic field (magnitude) across a vertical plane of one possible resonator volume, for resonant, fundamental modes one and two respectively;

FIG. 5*a* shows capacitive coupling in which the layout includes an aperture to support coupling between the two modes;

FIG. 5*b* shows inductive coupling in which the layout includes a wire to support coupling between the two mode;

FIG. 6*a* shows capacitive coupling in which the layout includes a probe to support coupling between the two modes;

FIG. 6*b* shows inductive coupling in which the layout includes at least one aperture to support coupling between the two modes;

DETAILED DESCRIPTION OF THE EMBODIMENTS

Before discussing the embodiments in any more detail, first an overview will be provided.

Figure 2:
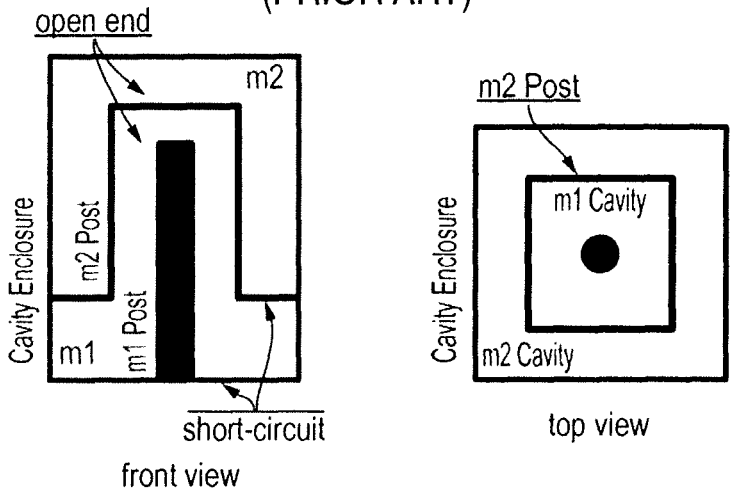
FIG. 2 illustrates schematically, in front and top views, a layout of a coaxial cavity resonator configured to support two resonances: fundamental resonant mode 1 and fundamental resonant mode 2.

FIG. 2 illustrates schematically one possible layout of a resonator assembly configured to support two resonances (i.e., resonant modes m1 and m2) in accordance with one arrangement. As can be seen from the front view and top view shown in FIG. 2 of one possible arrangement, a resonator enclosure is provided. The resonator enclosure shown is configured such that within a cavity enclosure there is provided two cavities. A first cavity for mode m1 is provided and supports operation of a first resonating element (i.e., post) for mode m1 placed within the first cavity. There is also provided a second resonant mode m2 supported by a second cavity for mode m2 and associated resonating element (i.e., post) for mode m2 shown in FIG. 2. As can be seen in FIG. 2, within a space comparable to that of a traditional cavity enclosure, there exists two cavities: a cavity for supporting resonant mode 1 and a cavity for supporting resonant mode 2. In the arrangement shown, the outer shell of the cavity provided for resonant mode 1 forms the resonating element associated with resonant mode 2. The common wall is configured to play two roles within the enclosure; first, forming a cavity enclosure for the resonant mode 1 and, second, providing a resonant element for the resonant mode 2. In a configuration such as that shown schematically in FIG. 2, the isolation between the two modes/resonances is infinite since they are totally isolated by a magnetic wall. The shaded areas within FIG. 2 each schematically represent a cavity, one provided for each mode, mode m1 and mode m2.

Figure 1:
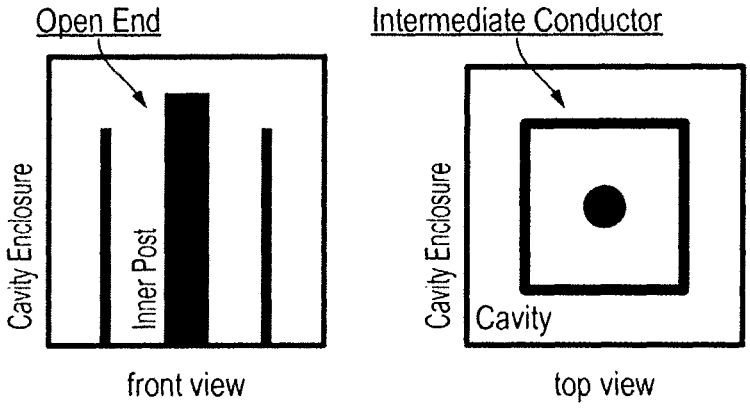
FIG. 1 (PRIOR ART)
FIG. 1 illustrates schematically, in front and top views, layout of an existing dual-resonance coaxial cavity resonator; including quarter wavelength resonating elements.

As can be seen schematically in FIG. 2, arrangements may be such that two short-circuit planes are provided and two open-end regions are provided for each resonating member. That is to say, there are two ground planes, one for each mode supported within the overall resonant enclosure. One difference between the arrangement shown schematically in FIG. 2 and that of some known arrangements, for example, that of FIG. 1, is that the resonant member for mode m1 has its own short circuit or ground plane. Provision of two separate ground planes allows for increased isolation between modes and, in the particular spatial physical arrangement shown in FIG. 2, there is provided an increased volume within which to store magnetic energy at resonance, thus allowing the m1 resonant mode to couple magnetically. Compared to known arrangements, an arrangement such as that shown schematically in FIG. 2 can allow for an improved physical configuration in relation to the coaxial resonating members in each cavity of the enclosure, that improved configuration allowing volume for magnetic energy storage and suppressing volume for electric energy storage, thus increasing in two ways the efficiency of the resonator and saving overall volume. An arrangement such as that shown schematically in FIG. 2 may also result in reduced complexity when achieving coupling between resonator enclosures and coupling between the two resonant cavities for modes m1 and m2 when compared to the resonator enclosure shown in FIG. 2.

It will be appreciated that the high level of isolation between the two resonances in an arrangement such as that shown in FIG. 2 may allow for a minimum sacrifice in overall Q-factor. The physical configuration shown schematically in FIG. 2 can result in reduced design complexity in relation to filters formed from such enclosures. In particular, for example, in an arrangement such as that shown in FIG. 2, tuning of the two resonances may be effected substantially independently. Furthermore, post-fabrication tuning ability may significantly reduce overall design complexity, consequently leading to improved costs and time-to-market improvements and thereby improved overall efficiency. Further benefits may occur in relation to filters formed from a plurality of enclosures such as that shown in FIG. 2, since the physical arrangement of the cavities (if operating at the same fundamental frequency) shown in FIG. 2 may allow for planning and improved arrangement of physical components to allow for transmission zeros within a signal which can be of importance when implementing efficient signal filters.

Figure 3:
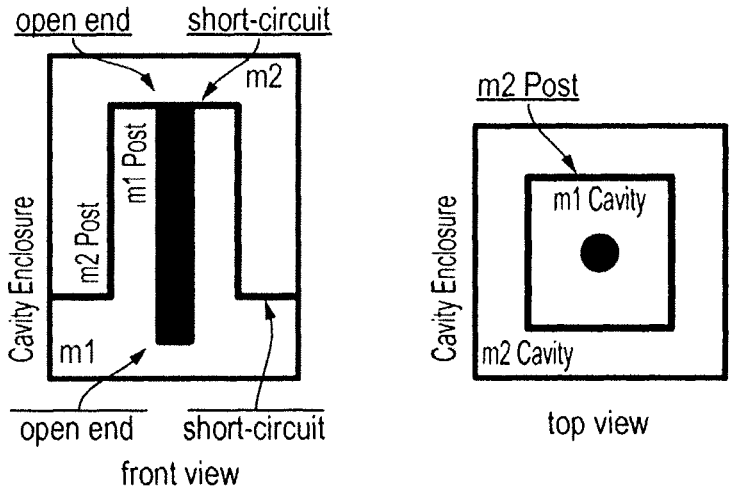
FIG. 3 illustrates schematically, in front and top views, an alternative layout of a coaxial cavity resonator configured to support two resonances: fundamental resonant mode 1 and fundamental resonant mode 2.

FIG. 3 illustrates schematically an alternative arrangement of a coaxial cavity resonator assembly which is configured to support two resonances. This arrangement may be such that two short-circuit planes are provided and two open-end regions are provided for each resonating member. The resonator enclosure shown is configured such that within a cavity enclosure there is provided two cavities. The embodiment shown in FIG. 3 includes a resonating member (i.e., post) in the cavity for mode m1 which extends downwardly from the inside of the resonating member (i.e., post) provided in the cavity for mode m2. It will be appreciated that provision of appropriate tuning screws in relation to the resonating members positioned in each cavity may allow for tuning of the appropriate resonating cavity.

FIGS. 4*a* through 4*d* illustrate schematically electric and magnetic field distributions within an arrangement such as that shown in FIG. 2. FIG. 4*a* and FIG. 4*b* show the distribution of the electric field (magnitude) on a vertical plane across the resonator volume for resonant fundamental modes m1 and m2 respectively. FIG. 4*a* shows the distribution of the electric field (magnitude) for mode m1 with the vertical axis reflecting E field values for the magnitude. FIG. 4*b* shows the distribution of the electric field (magnitude) for mode m2 with the vertical axis reflecting E field values for the magnitude. FIGS. 4*c* and 4*d* show the corresponding distribution of a magnetic field (magnitude) for modes m1 and m2 respectively. FIG. 4*c* shows the distribution of the magnetic field (magnitude) for mode m1 with the vertical axis reflecting H field values for the magnitude. FIG. 4*d* shows the distribution of the magnetic field (magnitude) for mode m2 with the vertical axis reflecting H field values for the magnitude. It can be seen from FIGS. 4*a* through 4*d* that the structural configuration of an arrangement such as that shown in FIG. 2 is such that the resulting resonator assembly can support two resonant modes. The two modes, as they appear in FIGS. 4*a* through 4*d*, are electrically isolated. FIGS. 4*c* and 4*d* show the corresponding distribution of magnetic field (magnitude) in relation to modes m1 and m2 supported within the cavity. The lighter shades of grey represent a higher intensity.

Arrangements such as those shown schematically in FIGS. 2 and 3 can be implemented using current mass-market low cost fabrication techniques. Although the complexity of a resonator assembly and any resulting filter assemblies may be slightly increased compared to standard coaxial technology, some of the benefits offered by such an arrangement may compensate for such increased complexity. Post-fabrication tuning of assemblies and filters including resonator assemblies such as those shown schematically in FIGS. 2 and 3 is unlikely to add additional complexity to those devices.

A resonator assembly such as that shown schematically in FIG. 2 or FIG. 3 may be constructed to operate in various ways. In particular, it will be understood that the two resonant cavities may be configured such that they support different resonant frequencies or the same resonant frequency. In either case it is possible to feed the relevant cavities independently or simultaneously. Various modes of operation are described in more detail below.

Dual Resonance—Filters and Diplexers

According to some arrangements, a dual resonance coaxial cavity resonator is provided. Such a structure may be configured to support two modes m1 and m2 at different frequencies or within different frequency bands: f1 and f2. Some configuration can be used to support dual band filters and diplexers. In relation to, for example, the arrangements shown schematically in FIGS. 2 and 3, the two modes supported are supported in the isolated cavities for modes m1 and m2 respectively. The two frequencies of the resonant cavities need not coincide and may be interchangeable. That is to say, f1 may be higher or lower in frequency than f2.

Dual Resonance—Duplexing

According to some configurations, a dual resonance coaxial cavity resonator is provided in a resonator enclosure such as that shown schematically in FIGS. 2 and 3. According to such a configuration, a structure is operable to support two modes of resonance at different frequencies, f1(m1, Tx1) and f2(m1, Rx1), where m1 stands for mode 1, m2 stands for mode 2, f1 stands for frequency band 1, f2 stands for frequency band 2. Tx1 indicates the filter functionality in relation to a transmission mode and Rx1 indicates the filter functionality in relation to a reception mode. The structure of FIGS. 2 and 3 are particularly suited to such functionality due to the high level of isolation provided between the two resonant cavities. It will be understood that in relation to configurations such as those shown in FIGS. 2 and 3, the resonance at f1 and f2 be such that the resonator enclosure can be used as a duplexing unit in a frequency division duplexing system. That is to say, one resonant cavity may be used for transmission and another for reception. It will further be understood that the previous configurations can be combined in order to provide a dual band duplexer.

Dual Mode

According to such a configuration, each of the two cavities for modes m1 and m2 provided in an arrangement such as that shown in FIGS. 2 and 3 may occur concurrently at the same frequency or within the same frequency band. According to such a configuration, it may be required that the two cavities provided within the enclosure, and the two fundamental resonances, are coupled. That is to say, cavities for modes m1 and m2 are no longer independent and are, instead, coupled.

FIGS. 5*a*, 5*b*, 6*a*, and 6*b* illustrate schematically various configurations according to which coupling between cavities for resonant modes m1 and m2 of a coaxial cavity resonator such as those shown in FIGS. 2 and 3 may be achieved. The resonator enclosure shown in FIGS. 5*a*, 5*b*, 6*a*, and 6*b* is configured such that within a cavity enclosure there is provided two cavities. The embodiments shown in FIGS. 5*a*, 5*b*, 6*a*, and 6*b* include a resonating member (i.e., post) in the cavity for mode m1 which extends upwardly from the enclosure and a resonating member (i.e., post) for mode m2 which is formed by the cavity for M1 that extends upwardly into the cavity for mode m2.

FIG. 7 illustrates field distributions of such coupled modes.

Figure 5A:
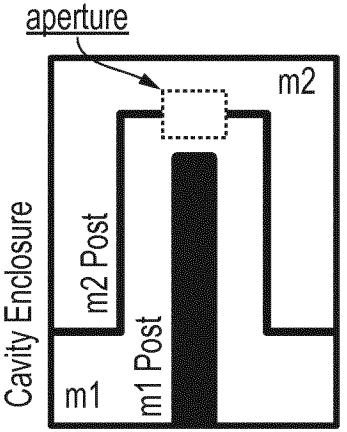
FIGS. 5*a* and 5*b* illustrate schematically, in side and plan view, layout configurations which allow for possible coupling between modes of a coaxial cavity resonator.
Figure 5A:
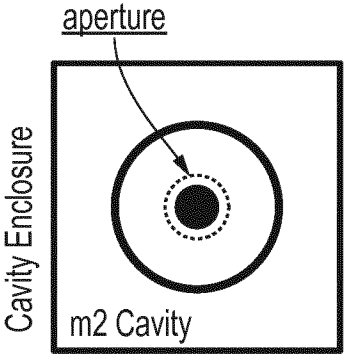
Figure 5B:
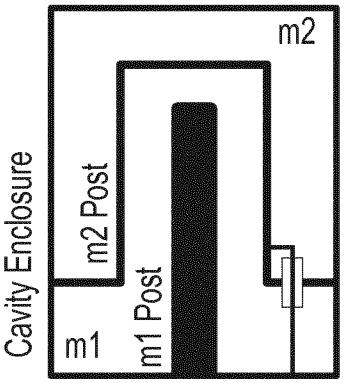
Figure 5B:
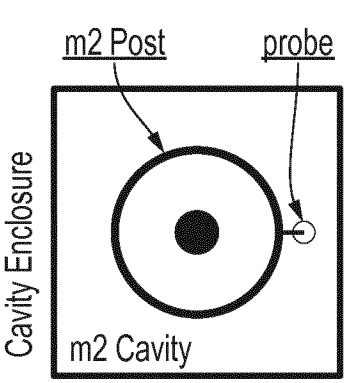

FIG. 5*a* illustrates schematically one configuration according to which capacitive coupling may be achieved. In the arrangement shown in FIG. 5*a*, an aperture is included in the post for mode m2 which supports coupling between the two modes m1 and m2. According to the configuration shown in FIG. 5*b*, inductive coupling is used and the configuration of the cavities for modes m1 and m2 are such that an inductive wire (i.e., probe) is provided. In such arrangements, f(m1) is the mode 1 frequency of resonance and f(m2) is the mode 2 frequency of resonance and, in the examples shown, they are the same frequency f.

Figure 6A:
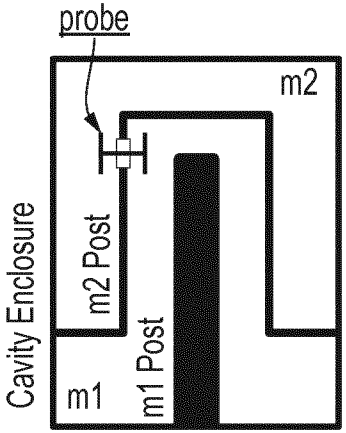
FIGS. 6*a* and 6*b* illustrate schematically, in side and plan view, layout configurations which allow for possible coupling between modes of a coaxial cavity resonator.
Figure 6A:
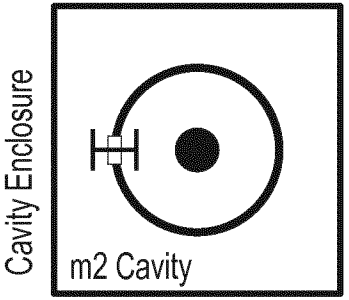
Figure 6B:
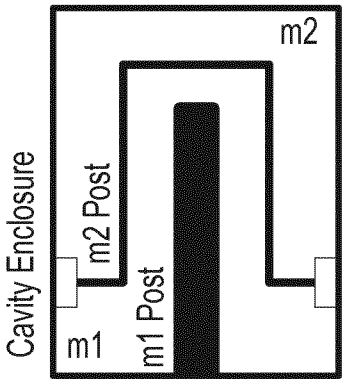
Figure 6B:
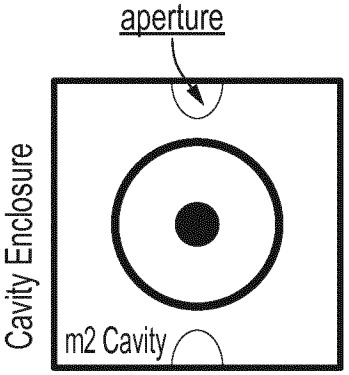

FIG. 6*a* and FIG. 6*b* illustrate schematically possible configurations for achieving coupling between modes of a coaxial cavity resonating assembly such as that shown in FIGS. 2 and 3. FIG. 6*a* illustrates a configuration according to which capacitative coupling is provided between cavities for modes m1 and m2. A probe is provided to support coupling between the two modes m1 and m2. FIG. 6*b* illustrates schematically inductive coupling. The configuration shown in FIG. 6*b* illustrates an arrangement in which one or more apertures are used to achieve such inductive coupling. Again, in the arrangement shown, the resonant frequency in mode m1 is the same as the resonant frequency of cavity for mode m2.

Figure 7A:
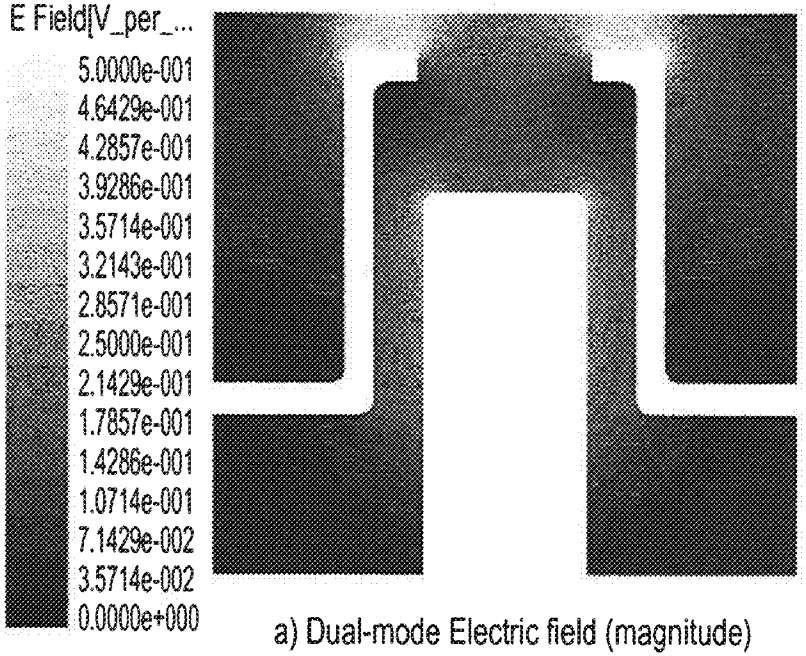
FIG. 7*a* illustrates the distribution of electric field (magnitude) across a vertical plane of one possible resonator volume.
Figure 7B:
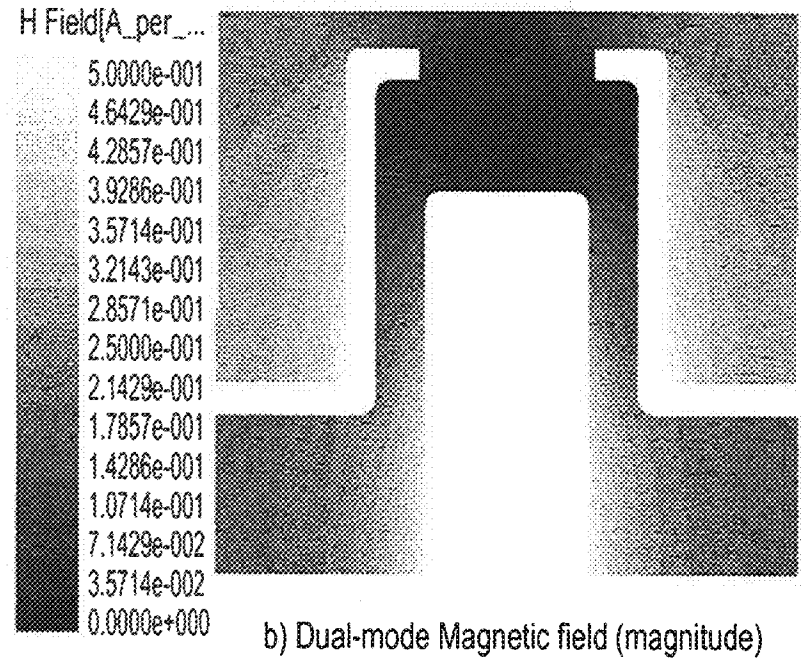
FIG. 7*b* illustrates the distribution of magnetic field (magnitude) across a vertical plane of one possible resonator volume.

FIG. 7*a* illustrates, for a particular configuration of a two-pole coaxial cavity filter, the magnitude of the dual-mode electric field within the cavities. FIG. 7*a* shows the distribution of the dual-mode electric field (magnitude) with the vertical axis reflecting E field values for the magnitude. FIG. 7*b* illustrates schematically for the same two-pole coaxial cavity filter the dual-mode magnetic field magnitude. FIG. 7*b* shows the distribution of the dual-mode magnetic field (magnitude) with the vertical axis reflecting H field values for the magnitude.

Dual Mode—Transmission Zeros

Figure 9A:
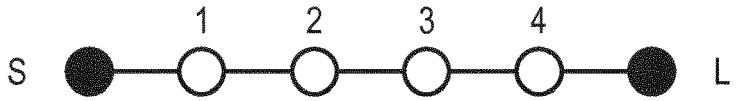
FIGS. 9*a* to 9*c* illustrate schematically various assembly coupling arrangements in which resonator arrangements can be used to achieve increased efficiency in cross-couplings in the coaxial cavity filter technology.
Figure 9B:
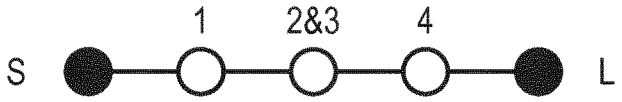
Figure 9C:
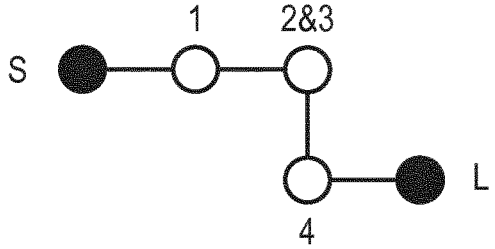
Figure 9C:
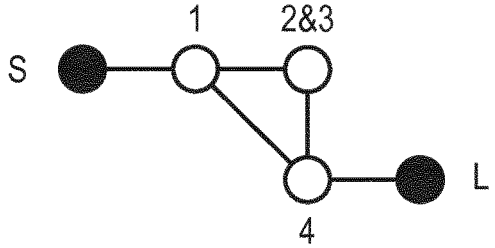

It has been recognised that when configured to operate in a dual mode, a resonator assembly such as that shown in FIG. 2 and FIG. 3 may be particularly suited to achieving transmission zeros in relation to cross couplings. FIGS. 9*a*, 9*b*, and 9*c* illustrate schematically coupling arrangements which allow increased flexibility in the way in which cross couplings can be achieved within a coaxial cavity filter arrangement comprising a plurality of resonator assemblies such as those shown in FIGS. 2 and 3.

Figure 8:
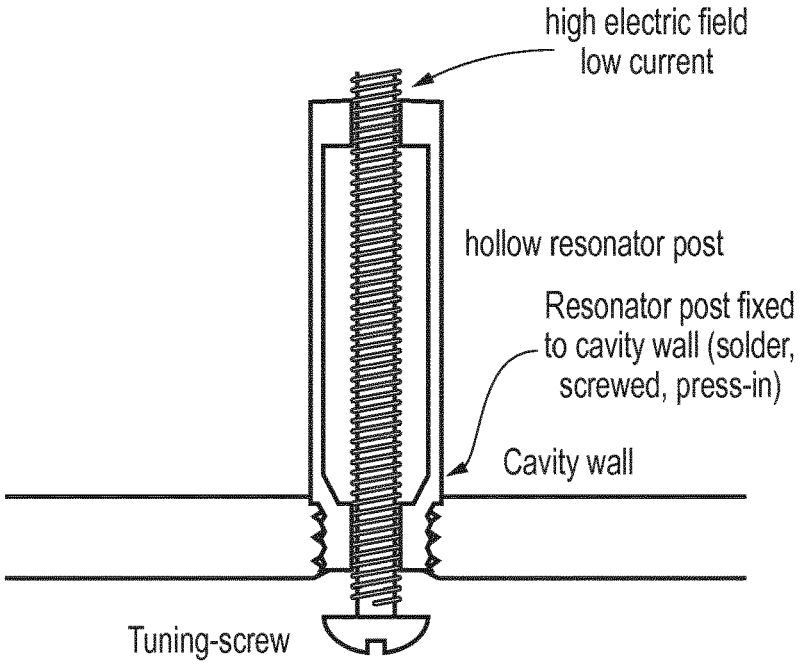
FIG. 8 illustrates schematically components of a possible resonant post which allows for post-fabrication tuning of one mode of a coaxial cavity filter.

FIG. 8 illustrates schematically one mechanism by which post-fabrication tuning within a resonator such as those shown in FIGS. 2 and 3 may be achieved. According to such an arrangement, a hollow resonating member in the form of a post is provided. That resonator post is fixed to the metallic cavity wall by one of soldering, being screwed in or pressed in. A tuning screw is provided which extends along the axis of the hollow resonator post. The tip of the tuning screw may extend beyond or through the end of the hollow resonator post. At the tip of the hollow resonator post or tuning screw, a high electric field with low current is achieved. Adjustment of the tuning screw within the hollow resonator post to project further from the hollow resonator post may allow for tuning of the resonating member within a resonant cavity. It will be appreciated that, tuning of a resonant assembly may be required post fabrication. Provision of tuning screws allows that post fabrication tuning to occur in an efficient manner. Use of tuning screws may relax manufacturing tolerance requirements.

FIGS. 9*a*, 9*b*, and 9*c* schematically various example coupling diagrams which demonstrate the flexibility and scalability of a resonator assembly such as that shown in FIGS. 2 and 3 if used in a manner where cavities for modes m1 and m2 support the same resonant frequency. In particular, it will be appreciated that such coupling diagrams demonstrate that a resonator assembly such as that shown in FIGS. 2 and 3 may be used in filters formed from multiple such assemblies to achieve increased efficiency in cross couplings.

FIG. 9*a* shows a typical coupling diagram for a 4 pole filter with a source S coupling feeding a signal to a series of poles 1, 2, 3, and 4, and a load L coupling that receives the signal from pole 4. In this coupling diagram each pole, 1 to 4 can have coupling only between neighbouring poles. Physical representations are similar to an inline filter which prohibits physical proximity of non-neighbouring resonators. In real life coaxial cavity filters, the coupling diagram is changed from that of FIG. 9*a* to a "folded" coupling diagram. A physical representation of such a filter is one in which cavities are placed across from each other in a so-called "folded" configuration. In this way, physical proximity of non-adjacent cavities can be achieved. Such a folded configuration allows for the introduction of transmission zeros (TZs) in a filter response by implementing cross-couplings, which create several paths for a filtered signal. Such a folded configuration has limitations in relation to the number of nonadjacent resonators which can be arranged to be in physical proximity to allow for the required the cross-couplings.

Figure 10:
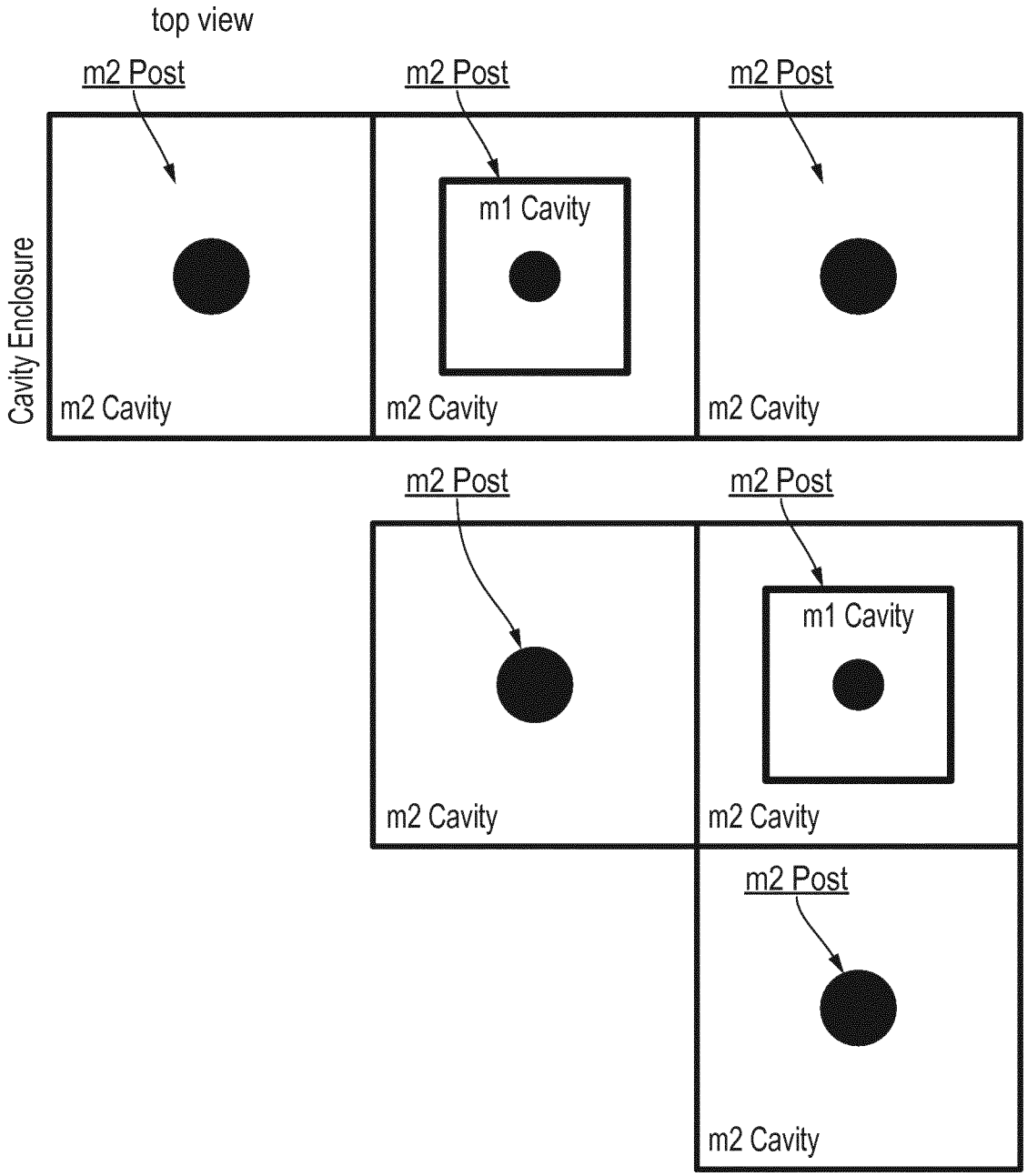
FIG. 10 illustrate schematically, in plan view, a layout of a coaxial cavity filter which achieves extended physical proximity as required to perform cross couplings.

FIG. 9*b* illustrates schematically a coupling diagram in which a source S coupling feeds a signal to a series of poles 1, 2&3, and 4, and a load L coupling receives the signal from pole 4. In this arrangement poles 2 and 3 of FIG. 9*a* with are replaced with a single pole: pole 2&3. This is possible since now poles 2&3 can take the physical form of a resonator enclosure such as that shown schematically in FIG. 2. This allows poles 1 and pole 4 to be brought into close proximity in a real physical configuration. FIG. 9*c* shows two coupling diagrams in which the source S coupling, pole 1, pole 2&3, pole 4, and load L coupling of FIG. 9*b* are coupled differently. The physical configuration of examples of resonator assemblies coupled together to form filters similar to those of FIGS. 9*b* and 9*c* are shown schematically in the top views of FIG. 10. The upper configuration shows a cavity enclosure having three resonator assemblies coupled in series. In this configuration the first resonator assembly includes a cavity and a post for resonant mode m2. The second resonator assembly includes a cavity and a post for resonant mode m1 and a cavity and a post for resonant mode m2. The third resonator assembly includes a cavity and a post for resonant mode m2. The lower configuration of FIG. 10 shows three resonator assemblies coupled together as shown in FIG. 9*c*. In this configuration the first resonator assembly includes a cavity and a post for resonant mode m2. The second resonator assembly includes a cavity and a post for resonant mode m1 and a cavity and a post for resonant mode m2. The third resonator assembly includes a cavity and a post for resonant mode m2.

FIGS. 9*a*, 9*b*, and 9*c* show alternative configurations which may be possible due to the configuration of a resonator enclosure such as the ones shown in FIGS. 2 and 3. FIGS. 9*a*, 9*b*, and 9*c* refer to configurations which employ one resonator enclosure such as that shown in FIG. 2, and shows the potential benefits of employing all or a number of the resonators in a filter to be of the form of the enclosure shown in FIG. 2.

Aspects and embodiments may provide for a reduction in size compared to a typical dual band resonant structure. That is to say, arrangements are such that limited additional physical space is required for a second resonant structure compared to a single resonant structure. Aspects and embodiments may provide for increased flexibility and scalability when building filters from resonant structures compared to conventional filtering solutions. Furthermore, aspects and embodiments may provide for improved out-of-band performance compared to conventional solutions.

A person of skill in the art would readily recognize that steps of various above-described methods can be performed by programmed computers. Herein, some embodiments are also intended to cover program storage devices, e.g., digital data storage media, which are machine or computer readable and encode machine-executable or computer-executable programs of instructions, wherein the instructions perform some or all of the steps of said above-described methods. The program storage devices may be, e.g., digital memories, magnetic storage media such as a magnetic disks and magnetic tapes, hard drives, or optically readable digital data storage media. The embodiments are also intended to cover computers programmed to perform said steps of the above-described methods.

The functions of the various elements shown in the Figures, including any functional blocks labelled as "processors" or "logic", may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, explicit use of the term "processor" or "controller" or "logic" should not be construed to refer exclusively to hardware capable of executing software, and may implicitly include, without limitation, digital signal processor (DSP) hardware, network processor, application specific integrated circuit (ASIC), field programmable gate array (FPGA), read only memory (ROM) for storing software, random access memory (RAM), and non-volatile storage. Other hardware, conventional and/or custom, may also be included. Similarly, any switches shown in the Figures are conceptual only. Their function may be carried out through the operation of program logic, through dedicated logic, through the interaction of program control and dedicated logic, or even manually, the particular technique being selectable by the implementer as more specifically understood from the context.

It should be appreciated by those skilled in the art that any block diagrams herein represent conceptual views of illustrative circuitry embodying the principles of the invention. Similarly, it will be appreciated that any flow charts, flow diagrams, state transition diagrams, pseudo code, and the like represent various processes which may be substantially represented in computer readable medium and so executed by a computer or processor, whether or not such computer or processor is explicitly shown.

The description and drawings merely illustrate the principles of the invention. It will thus be appreciated that those skilled in the art will be able to devise various arrangements that, although not explicitly described or shown herein, embody the principles of the invention and are included within its spirit and scope. Furthermore, all examples recited herein are principally intended expressly to be only for pedagogical purposes to aid the reader in understanding the principles of the invention and the concepts contributed by the inventor(s) to furthering the art, and are to be construed as being without limitation to such specifically recited examples and conditions. Moreover, all statements herein reciting principles, aspects, and embodiments of the invention, as well as specific examples thereof, are intended to encompass equivalents thereof.

The invention claimed is:

1. A resonator assembly comprising:

a first resonator cavity and a first resonant member; and a second resonator cavity and a second resonant member;

said first resonant member being located within said first resonator cavity and arranged to receive a first signal via a first signal coupling associated with the first resonator cavity, wherein the first resonant member is configured to resonate within said first resonator cavity at a first fundamental frequency;

said second resonant member being located within said second resonator cavity and arranged to receive a second signal via a second signal coupling associated with the second resonator cavity, wherein the second resonant member is configured to resonate within said second resonator cavity at a second fundamental frequency;

wherein said first and second fundamental frequencies are different and at least a portion of said first resonator cavity forms said second resonant member;

wherein a first resonator cavity surface, from which said first resonant member extends is offset from a second resonator cavity surface from which said second resonant member extends;

wherein said first and second resonator cavities are configured to be substantially isolated from each other.

2. The resonator assembly according to claim 1, wherein said first and second resonator cavities are configured to be substantially electrically and magnetically isolated from each other.

3. The resonator assembly according to claim 1, wherein said second resonator cavity comprises a cavity having a non-uniform cross-sectional area along a length of said cavity.

4. The resonator assembly according to claim 3, wherein said first resonator cavity is configured in a general form of an inverted mushroom, a stem of said mushroom forming said second resonant member.

5. The resonator assembly according to claim 1, wherein at least one of said first and second resonator cavities comprises:

a tunable screw extending into respective ones of at least one of said first and second resonator cavities.

6. The resonator assembly according to claim 1, wherein configuring said second resonant member to resonate within said second resonator cavity at said second fundamental frequency comprises:

selecting at least one physical dimension of said second resonant member.

7. A filter comprising:

a plurality of resonator assemblies comprising an input resonator assembly, other resonator assemblies, and an output resonator assembly arranged such that a source signal received at said input resonator assembly passes through said other resonator assemblies and is output at said output resonator assembly as a load signal;

a source coupling configured to provide said source signal to an input resonator member of said input resonator assembly such that said source signal excites said input resonator member, said input and other resonator assemblies of said plurality of resonator assemblies being arranged such that said source signal is transferred between said input and other resonator assemblies to an output resonator member of said output resonator assembly; and a load coupling configured to receive said load signal from said output resonator assembly;

wherein said plurality of resonator assemblies comprises at least one resonator assembly according to claim 1 such that:

where said at least one resonator assembly includes said input resonator assembly, the input resonator member of the input resonator assembly comprises the first resonant member of the first resonator cavity of the resonator assembly;

where said at least one resonator assembly is one of the other resonator assemblies, said other resonator assembly comprises the first resonator cavity, the first resonant member, the second resonator cavity, and the second resonator member of the resonator assembly; and where said at least one resonator assembly includes said output resonator assembly, the output resonator member of the output resonator assembly comprises the second resonant member of the second resonator cavity of the resonator assembly.

8. The filter according to claim 7, wherein the plurality of resonator assemblies comprise two resonator assemblies, said two resonator assemblies being adjacent resonator assemblies such that said two resonator assemblies include the input resonator assembly and one other resonator assembly adjacent thereto, two other resonator assemblies adjacent to each other, or one other resonator assembly and the output resonator assembly adjacent thereto, wherein said adjacent resonator assemblies are configured such that said source signal is passed between first resonator cavities of the adjacent resonator assemblies and said source signal is passed between second resonator cavities of the adjacent resonator assemblies.

9. The filter according to claim 7, wherein the plurality of resonator assemblies comprise two resonator assemblies, said two resonator assemblies being adjacent resonator assemblies such that said two resonator assemblies include the input resonator assembly and one other resonator assembly adjacent thereto, two other resonator assemblies adjacent to each other, or one other resonator assembly and the output resonator assembly adjacent thereto, wherein said adjacent resonator assemblies are configured such that said source signal can be passed between first resonator cavities of the adjacent resonator assemblies or said source signal can be passed between second resonator cavities of the adjacent resonator assemblies.

10. The filter according to claim 7, configured to form a filter element of a duplexer.

11. The resonator assembly according to claim 1, wherein at least one of said first and said second resonant members comprise a resonating post.

12. The resonator assembly according to claim 1, wherein configuring said first resonant member to resonate within said first resonator cavity at said first fundamental frequency comprises:

selecting at least one physical dimension of said first resonant member.

13. A filter comprising:

a plurality of resonator assemblies, said plurality of resonator assemblies comprising an input resonator assembly, other resonator assemblies, and an output resonator assembly arranged such that a source signal received at said input resonator assembly passes through said other resonator assemblies and is output at said output resonator assembly as a load signal;

a source coupling configured to provide said source signal to said input resonator assembly, said input and other resonator assemblies of said plurality of resonator assemblies being arranged such that said source signal is transferred between said input and other resonator assemblies to said output resonator assembly; and a load coupling configured to receive said load signal from said output resonator assembly;

wherein said plurality of resonator assemblies comprises at least one resonator assembly, the at least one resonator assembly being the input resonator assembly, at least one of the other resonator assemblies, or the output resonator assembly, the at least one resonator assembly comprising:

a first resonator cavity and a first resonant member; and a second resonator cavity and a second resonant member;

said first resonant member being located within said first resonator cavity, where the at least one resonator assembly is the input resonator assembly, said first resonant member is arranged to receive said source signal via said source coupling and said source coupling is associated with the first resonator cavity, where the at least one resonator assembly is one of the other resonator assemblies or the output resonator assembly, said first resonant member is arranged to receive said source signal via a first signal coupling associated with the first resonator cavity, wherein the first resonant member is configured to resonate within said first resonator cavity at a first fundamental frequency;

said second resonant member being located within said second resonator cavity and arranged to receive said source signal via a second signal coupling associated with the second resonator cavity, wherein the second resonant member is configured to resonate within said second resonator cavity at a second fundamental frequency;

wherein at least a portion of said first resonator cavity forms said second resonant member;

wherein a first resonator cavity surface, from which said first resonant member extends, is offset from a second resonator cavity surface, from which said second resonant member extends;

wherein said first and second resonator cavities are configured to be substantially electrically and magnetically isolated from each other.

14. The filter according to claim 13, wherein said first and second fundamental frequencies are different.

15. The filter according to claim 13, wherein said first and second fundamental frequencies are substantially identical.

16. The filter according to claim 15, wherein said second signal coupling is coupled to said first resonator cavity such that said second resonant member receives said source signal from said first resonator cavity.

17. A resonator assembly comprising:

a first resonator cavity and a first resonant member; and a second resonator cavity and a second resonant member;

said first resonant member being located within said first resonator cavity and arranged to receive a first signal via a first signal coupling associated with the first resonator cavity, wherein the first resonant member is configured to resonate within said first resonator cavity at a first fundamental frequency;

said second resonant member being located within said second resonator cavity and arranged to receive a second signal via a second signal coupling associated with the second resonator cavity, wherein the second resonant member is configured to resonate within said second resonator cavity at a second fundamental frequency;

wherein said first and second fundamental frequencies are different and at least a portion of said first resonator cavity forms said second resonant member, wherein a first resonator cavity surface from which said first resonant member extends is offset from a second resonator cavity surface from which said second resonant member extends;

wherein said first and second resonator cavities are configured to be substantially electrically and magnetically isolated from each other.

18. The resonator assembly according to claim 17, wherein said second resonator cavity comprises a cavity having a non-uniform cross-sectional area along a length of said cavity.

19. The resonator assembly according to claim 17, wherein at least one of said first and second resonator cavities comprises:

a tunable screw extending into respective ones of at least one of said first and second resonator cavities.

20. The resonator assembly according to claim 17, wherein at least one of said first and said second resonant members comprise a resonating post.

* * * * *